US006973743B1

(12) United States Patent
Mowery

(10) Patent No.: US 6,973,743 B1
(45) Date of Patent: Dec. 13, 2005

(54) GOLD SHOE INSOLE INSERT

(76) Inventor: Tom Mowery, 527 NW. 35th Ter., Gainesville, FL (US) 32607

( * ) Notice: Subject to any disclaimer, the term of this patent is extended or adjusted under 35 U.S.C. 154(b) by 162 days.

(21) Appl. No.: 10/643,702

(22) Filed: Aug. 18, 2003

Related U.S. Application Data

(60) Provisional application No. 60/433,280, filed on Dec. 10, 2002.

(51) Int. Cl.[7] ..... A43B 13/38

(52) U.S. Cl. ..... 36/43; 36/44; 36/144; 36/174; 36/127

(58) Field of Search ..... 36/43, 44, 144, 36/174, 178, 127, 143, 142

(56) References Cited

U.S. PATENT DOCUMENTS

| | | | | |
|---|---|---|---|---|
| 2,067,240 A | | 1/1937 | Musebeck | |
| 4,364,189 A | | 12/1982 | Bates | |
| 4,510,700 A | * | 4/1985 | Brown | 36/44 |
| 4,682,425 A | | 7/1987 | Simmons | |
| 4,864,739 A | * | 9/1989 | Maestri | 36/43 |
| 4,953,311 A | | 9/1990 | Bruggemeier | |
| 5,187,885 A | | 2/1993 | Murphy | |
| 5,212,894 A | | 5/1993 | Paparo | |
| 5,265,354 A | | 11/1993 | Aliano, Jr. | |
| 5,345,701 A | * | 9/1994 | Smith | 36/144 |
| 5,564,989 A | | 10/1996 | Larsen | |
| 5,746,011 A | * | 5/1998 | Hedstrom | 36/44 |
| 5,842,294 A | * | 12/1998 | Fabricant | 36/127 |
| 5,933,984 A | * | 8/1999 | Carlson et al. | 36/43 |
| 6,176,025 B1 | | 1/2001 | Patterson et al. | |
| D446,837 S | | 8/2001 | Patterson et al. | |
| 2001/0015022 A1 | | 8/2001 | Singer et al. | |
| 2002/0083618 A1 | * | 7/2002 | Erickson et al. | 36/44 |

OTHER PUBLICATIONS

Whittle, M., "Generation and attenuation of transient impulsive forces beneath the foot: a review", *Gait and Posture*, 1999, pp. 264-275, vol. 10, Elvesier Science B.V.

Curryer, M. et al., "Effectiveness and Various Materials in Reducing Plantar Shear Forces. A Pilot Study", *Journal of the American Podiatric Medical Association*, Jul./Aug. 2000, pp. 346-353, vol. 90, No. 7.

* cited by examiner

*Primary Examiner*—Ted Kavanaugh
(74) *Attorney, Agent, or Firm*—Saliwanchik, Lloyd & Saliwanchik

(57) ABSTRACT

Golf shoe insole inserts for improving the position of a golfer's body during a golf swing while stabilizing the feet against both over-pronation and over-supination. The golf shoe insert according to the present invention has an upper portion fashioned to support the entire bottom of the foot, including the transverse arch, the longitudinal arch, and the heel. In particular, the upper portion of the orthopedic insert supports bottom regions of the foot from the posterior plantar surface of the metatarsus through the plantar surface of the lesser tarsus to the posterior plantar surface of the rear foot. The upper portion of the subject orthopedic insert includes a deep heel cup to aid in stabilizing the foot and providing support at the back of the foot.

20 Claims, 5 Drawing Sheets

GOLD SHOE INSOLE INSERT

CROSS-REFERENCE TO A RELATED APPLICATION

This application claims the benefit of provisional patent application Ser. No. 60/433,280, filed Dec. 10, 2002.

FIELD OF THE INVENTION

The subject invention relates to a shoe insert, and more particularly to a golf shoe insert that is removable, adjustable to the golfer's foot size and shape, and that can confer support and stability to the golfer's foot to aid in teaching the golfer how to attain an optimal golf swing as well as to prevent and/or treat stress/injuries associated with golfing activities.

BACKGROUND OF INVENTION

In golf, one of the most important skills in the game is proper body position in executing a golf swing. To generate the optimum golf swing, the shifting of weight from the back foot to the front foot plays a key role. The actual dynamic motion of each foot during the golf swing is different when comparing the position and motion of the back foot with the position and motion of the front foot. Specifically, at club impact on the ball and follow through, the front foot during the weight shift should roll about its longitudinal axis and the body weight should be on the outside of the front foot at the end of the swing. In contrast, the back foot should remain firmly planted with the weight on the inside of the rear foot and during the initial part of the swing to allow the weight to transfer from the back foot to the front foot. Thus, the ideal golf swing requires somewhat unnatural movement of the skeletal and muscular structure in human beings. Often, a golfer must train his muscles to move in exactly the right manner to obtain a proper swing to cause the ball to be driven along a straight, intended path.

It has long been recognized that the lower body is the foundation to a powerful and consistent golf swing. When executing a back swing without proper foot support, the inside back foot will generally roll to the side and the body becomes misaligned. Further, weight transferring to the outside front foot during a downswing and follow-through results in lateral hip movement ("swaying" of the lower body). Swaying weakens a player's foundation, often causing an undesirable path of the ball, such as a hook or slice.

There are many training devices available to assist in teaching the proper golf swing and weight distribution described above. For example, a pair of golf shoes currently available to the golfer includes wedged heels incorporated into the shoes that provide a slope downward to the heel region as well as an inward and downwardly convergent relationship between the shoes. Such shoes cause the entire weight to be transposed back through the heel region, which does not provide an optimum golf swing. Further, such shoes are very uncomfortable for normal walking.

Temporary attachable wedges to be applied to either the instep area, the area slightly forward in the sole region, or the area on the outside edge of the feet are also available to aid in assisting the golfer in performing a proper swing. Such devices do not produce proper weight distribution through the heel and the sole of the foot. Accordingly, little aid is afforded the golfer in performing the optimum swing.

Golf regularly causes or contributes to a variety of injuries. For example, *plantar fasciitis* is the inflammation of connective tissue fibers that run between the heel bone and the ball of the foot. When walking long distances, repetitive overloading between the plantar fascia and the heel bone attachment can cause a breakdown of the connective tissue fibers. If left untreated, the constantly irritated tendinous junction will eventually produce a calcified spur. Many injuries related to golfing activities may be treated or prevented with the use of orthotics.

Most traditional golf shoes lack any orthotic properties. Further, training inserts touted to improve performance provide little support or stability for the foot while walking in golf shoes. The stress imposed from walking a golf course without adequate orthotic support can lead to fatigue and even serious trauma. In addition, stress induced by extensive walking or other golfing activities may detrimentally affect the golfer's swing.

An orthotic is currently available to provide protection against both over-pronation and over-supination by supporting the heel region of the golfer's foot. Specifically, the orthotic conforms throughout the heel to the metatarsal heads and does not encompass the entire foot. This orthotic does not aid in teaching the golfer how to attain an optimal golf swing.

The foregoing devices do not effectively optimize a golfer's swing while allowing a golfer to walk normally and comfortably. Further, typical golf shoes provide little orthopedic support while helping to improve the golf swing. Proper foot support is important in preventing serious foot injuries. For example, proper foot support aids in absorbing shock to the spine when walking, in addition to protecting the foot, specifically the longitudinal and metatarsal arches as well as the heel. Thus, current golf shoes do not include good arch support nor heel protection, such as a proper heel counter to provide support at the back of the shoe.

BRIEF SUMMARY OF THE INVENTION

The present invention relates to a golf shoe insert that is removable. Further, the subject golf shoe insert is adjustable to the size and contours of a golfer's foot. The golf shoe insert also advantageously provides orthopedic support and stability while simultaneously positioning the golfer's feet to aid in attaining an optimal golf swing. In an embodiment, the subject golf shoe inserts selectively support and position regions of the bottom of the foot, including the arch and the region rearward of the toes (i.e., rearward of the ball of the foot).

The subject golf shoe inserts are constructed and designed to provide comfortable, custom-fitting support and stability to the particular foot of the user relative to the floor of the golf shoe, so as to selectively and correctly position the foot, including the heel and the longitudinal and metatarsal arches, to provide the user with an ideal golf swing while reducing the likelihood of swaying. The subject golf shoe insert also aids in selectively and correctly supporting and positioning the user's legs relative to the footwear to prevent lateral hip movement during a golf swing. An embodiment of the present invention causes an inward cant of the back portion of the foot to provide a proper foundation for an ideal golf swing.

The subject invention also addresses injuries and stress associated with the sport of golf. In an embodiment, the subject golf inserts provide support to both the transverse arch and the longitudinal arch of the foot. A deep heel cup aids in stabilizing the foot and providing support at the back of the foot. The inserts according to the subject invention advantageously aid in treating and/or preventing certain stress and trauma related to golfing activities by providing support and stability to the golfer's foot.

Depending on manufacturing criteria and the golfer's needs, the golf shoe insole insert of the invention can be formed of a single layer or multiple layers. The layer(s) of the insole insert are composed of visoelastic materials well known to the skilled artisan. Contemplated visoelastic materials include, but are not limited to, polyurethane elastomers, polyurethane foams, polyvinyl chloride foams, ethylene vinyl acetate, rubber materials such as synthetic rubber foams and silicone rubber, glues combined with fiberglass, gels such as commercially available SOFT SHEAR (Silipos, New York, N.Y.) and Conformagel (Kendall Co., Mansfield, Mass.), and the like.

Accordingly, the golf shoe insert of the invention provides an orthotic that protects against both over-pronation and over-supination, and confers an improved cushioning system to afford gentle, resilient support to the foot. With such support and position, the insert prevents or provides relief from common golfing pathologies including, for example, flat foot, high arches, heel spurs, and foot fatigue. Further, the golf shoe insert is easily personalized to an individual's foot size and shape.

More importantly, the insert of the present invention provides a means for maintaining a golfer's support foot in a neutral position during a golf swing. In one embodiment, the present invention provides arch support and counterforce to balance the golfer's stance and prevent ankle roll. In a related embodiment, the present invention provides a heel cup and is composed of semi-rigid material to provide support and optimal shock absorption.

The subject golf shoe insert is to be used in lieu of the existing insole in a golf shoe. Once the existing insole in a golf shoe is removed, the subject golf shoe insert can be cut to the shape and size of an individual's foot and then placed within the golf shoe. The individual then wears the emplaced insert to support the foot and aid in improving the individual's golf swing.

DETAILED DISCLOSURE OF THE INVENTION

Figure 1:
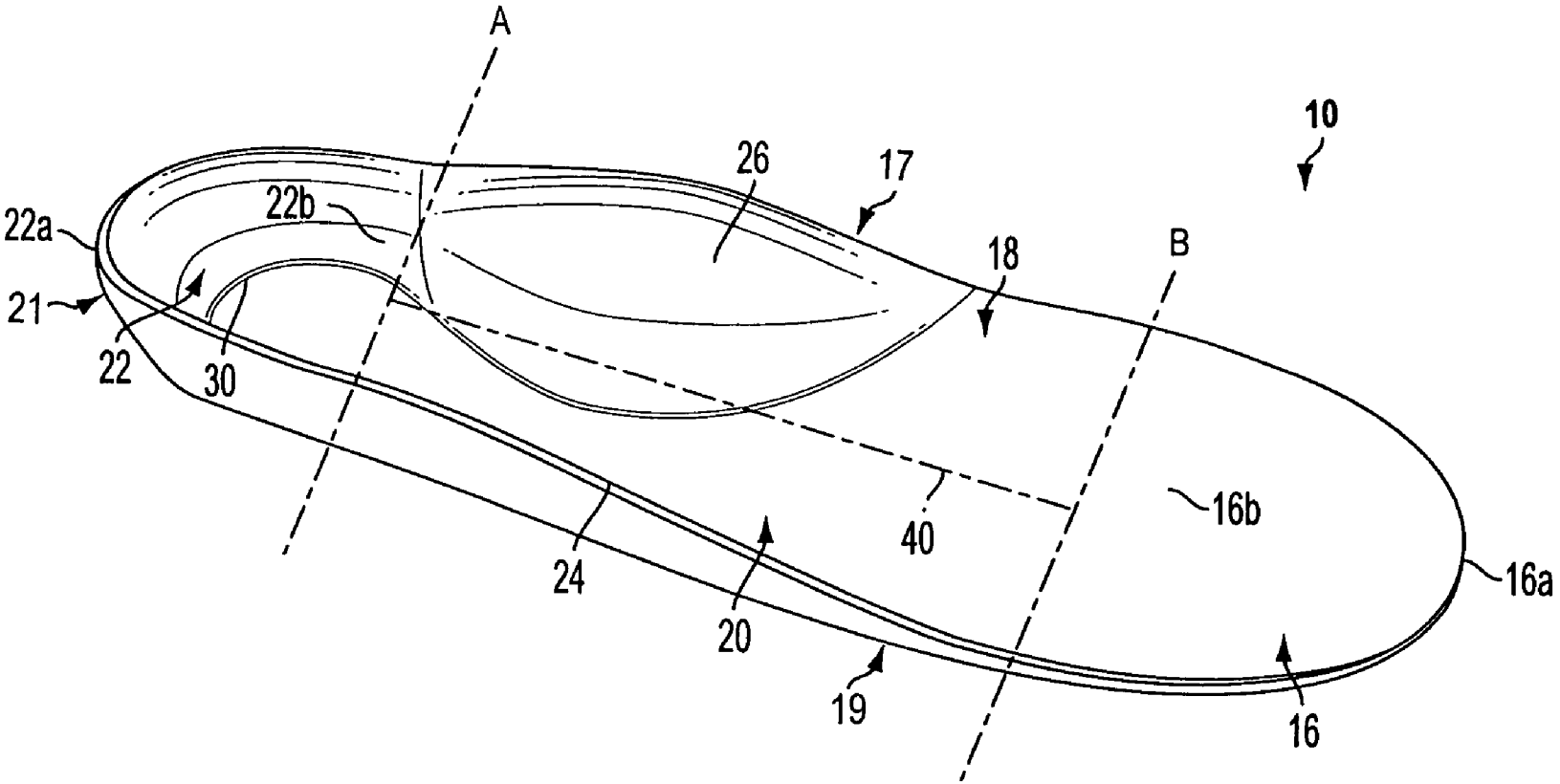
FIG. 1 illustrates a perspective top view of an insert for a right golf shoe in accordance with the present invention.
Figure 2:
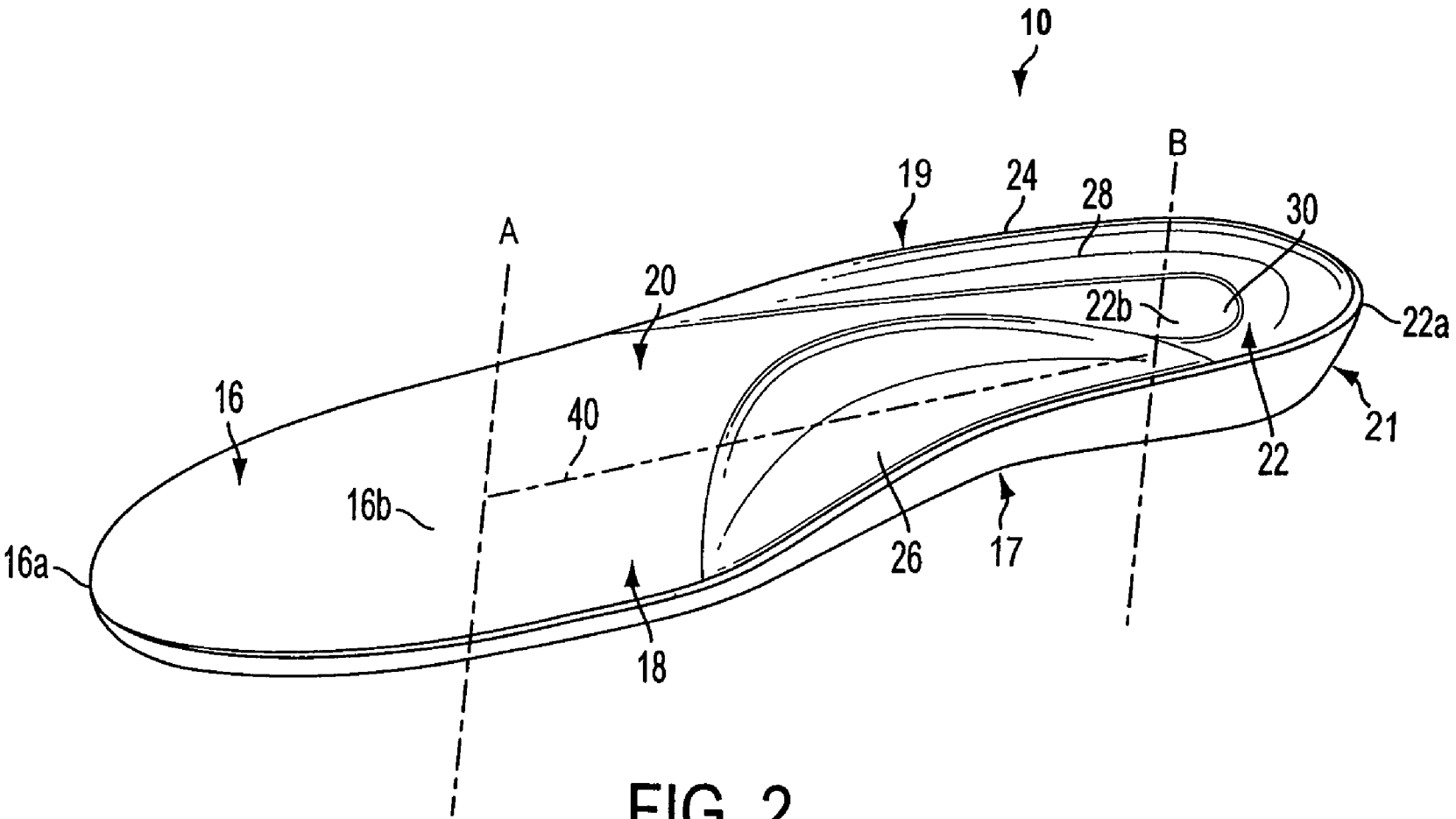
FIG. 2 illustrates another perspective top view of an insert for a right golf shoe in accordance with the present invention.
Figure 3:
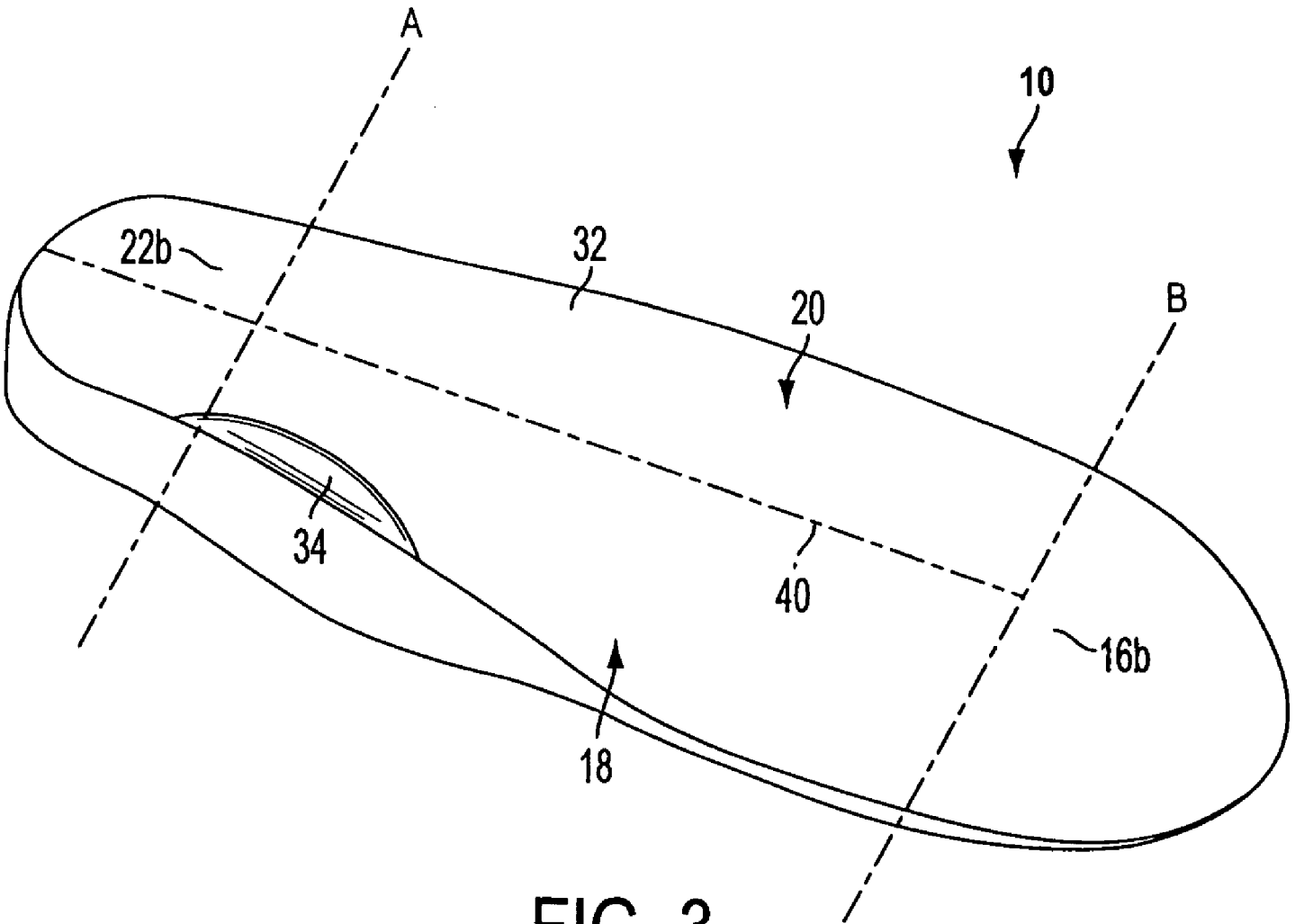
FIG. 3 illustrates a perspective bottom view of an insert for a right golf shoe in accordance with the present invention.
Figure 4B:
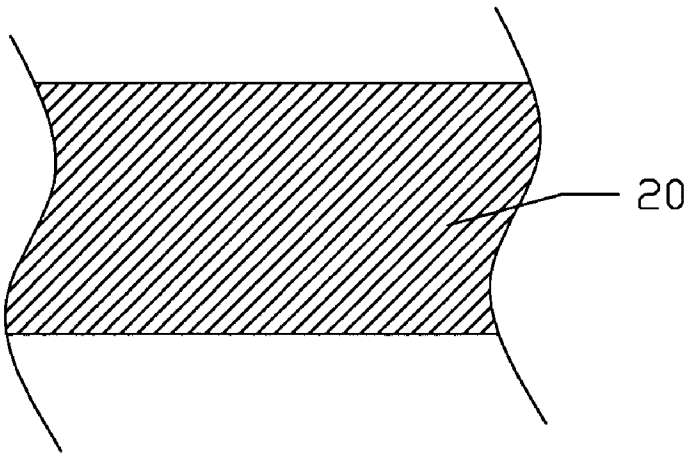
FIG. 4B represents a cross-section of the lateral region of an embodiment of the invention that is formed of one layer.
Figure 4A:
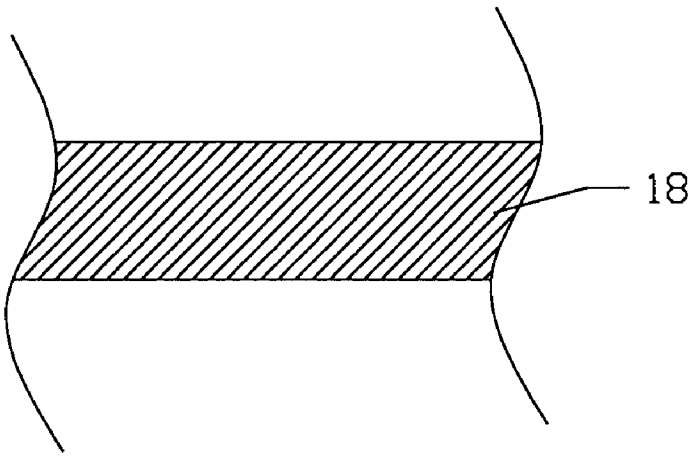
FIG. 4A represents a cross-section of the medial region of an embodiment of the invention that is formed of one layer.
Figure 5B:
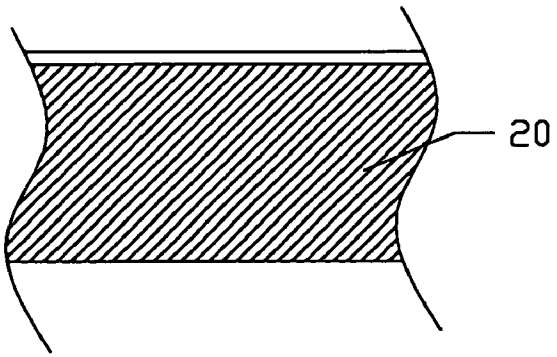
FIG. 5B represents a cross-section of the lateral region of an embodiment of the invention that is formed of two layers.
Figure 6B:
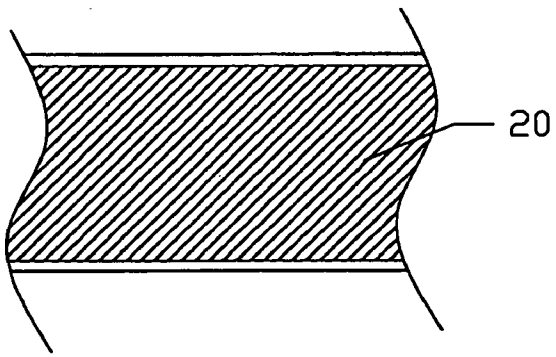
FIG. 6B represents a cross-section of the lateral region of an embodiment of the invention that is formed of three layers.
Figure 5A:
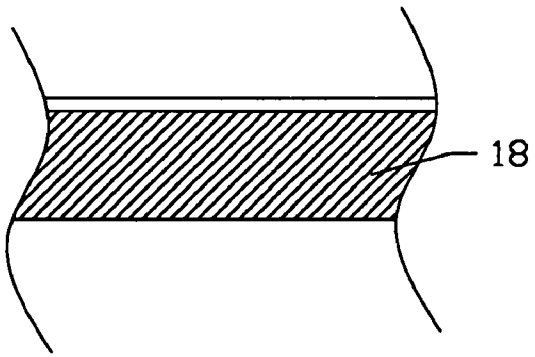
FIG. 5A represents a cross-section of the medial region of an embodiment of the invention that is formed of two layers.
Figure 6A:
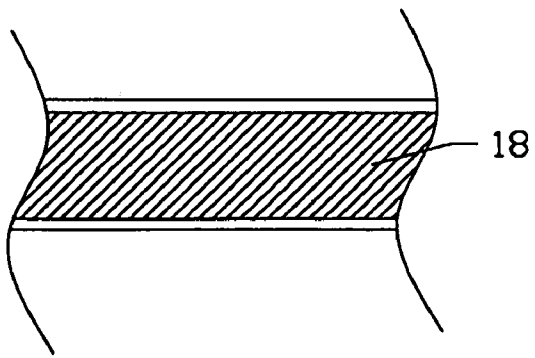
FIG. 6A represents a cross-section of the medial region of an embodiment of the invention that is formed of three layers.

The subject orthopedic inserts for golf shoes support (and position) the entire bottom of the foot, including the arch, rearward or exclusive of the toes. That is, the inserts support the foot from the plantar surface of the metatarsus through the plantar surface of the lesser tarsus to the posterior plantar surface of the rear foot. Although the subject orthopedic inserts for the right foot are illustrated in FIGS. 1–3, a similar insert would be provided for the left foot. It is to be understood that the subject orthopedic inserts will usually be employed in complimentary pairs for a right foot and a left foot.

Referring now to FIGS. 1–3, the main body 10 of the orthopedic insert of the invention has a thin base and is fashioned to support and cushion the entire bottom of the foot, including the transverse arch, the longitudinal arch, and the heel of the foot. The main body 10 provides orthopedic support for the bottom regions of a foot from the posterior plantar surface of the metatarsus through the plantar surface of the lesser tarsus to the posterior plantar surface of the rear foot.

The main body 10 includes a toe region 16 having a distal toe region 16*a* and a proximal toe region 16*b*; a medial region 18, a medial edge 17, a lateral region 20; a lateral edge 19; a heel region 22; and a heel edge 21. The heel region has a distal heel region 22*b* and a proximal heel region 22*a*. The medial region 18 and the lateral region 20 are separated along a longitudinal center-line 40. The medial region 18 and the lateral region 20 are located substantially within the dotted lines A and B, from the proximal toe region 16*b* to the distal heel region 22*b*.

The upper surface of the main body 10, as illustrated in FIGS. 1 and 2, includes a deep heel cup 30 at the heel region 22 to aid in stabilizing the feet and providing support at the back of the feet. Also located on the upper surface of the main body 10 is a flange 24 that is formed along the medial edge 17, lateral edge 19, and heel edge 21 of the main body 10. The flange 24 gradually extends upward from the medial edge 17 to fully extend vertically along the heel edge 21, from which the flange 24 gradually tapers off along the lateral edge 19 to end at the thin, flat base of the main body 10 near the proximal toe region 16*b*.

The upper surface of the main body 10 also includes an upper arch conforming slope 26. The upper arch conforming slope 26 is located at the medial region 18. The upper arch conforming slope 26 gradually increases in height from the thin, flat base of the main body 10 at the distal heel region 22*b* along the medial region 18 and then gradually decreases in height from the medial region 18 to the thin, flat base of the main body 10 near the proximal toe region 16*b*. The upper arch conforming slope advantageously aids in treating and/or preventing certain stress and trauma related to golfing activities by providing support and stability to the golfer's foot.

The toe region 16 of the main body 10, from the distal toe region 16*a* to the proximal toe region 16*b* is formed from the thin, flat base. From the proximal toe region 16*b* through the lateral 20 and medial 18 regions, the base of the main body 10 gradually thickens 28. At the heel region 22, the base of the main body 10 forms a heel cup 30.

The heel cup 30 aids in stabilizing the foot and providing support at the back of the foot. In one embodiment, the subject golf shoe/orthopedic inserts support (and position) the bottom of the foot rearward of the vicinity of the ball of the foot, in particular both the transverse arch and the longitudinal arch of the foot. In a related embodiment, the present invention provides arch support and counterforce to balance the golfer's stance and prevent ankle roll. In a further related embodiment, the present invention provides a heel cup that is composed of semi-rigid material to provide support and shock absorption.

The lower surface of the main body 10 is illustrated in FIG. 3 and includes a thickened portion 32 that runs longitudinally along the lateral region 20 of the lower surface of the main body 10. The thickened portion 32 runs from substantially the distal fifth metatarsal bone to the heel of a foot. The thickened portion 32 is thickest along the transverse arch of the foot and tapers to the thin base at the toe and along the longitudinal center-line 40 of the main body 10. The thickened portion 32 is of substantially the same thickness along the lateral region 20, from the transverse arch of a foot to the heel. The thickened portion 32 provides foot support while causing an inward cant of the back portion of the foot to provide a proper foundation for an ideal golf swing.

The lower surface of the main body 10 also includes a lower arch conforming slope which 34 gradually progresses downward from the plane of thin base at the distal heel region 22*b* through the medial region 18 to gradually progress upward to the plane of the thin base at the proximal toe region 16*b*. The thickened portion 32 and the lower arch conforming slope 34 provide support and stability to the particular foot of the user relative to the floor of the golf shoe, so as to selectively and correctly position the foot, including the heel and the longitudinal and metatarsal arches, to provide the user with an ideal golf swing while reducing the likelihood of swaying. Further, the thickened portion 32 and the lower arch conforming slope 34 provide a means for maintaining the support foot in a neutral, balanced position during a golf swing.

In use, the subject golf shoe insert of the invention can aid in selectively and correctly supporting and positioning the user's legs relative to the golf shoes to prevent lateral hip movement during a golf swing. By doing so, the orthopedic golf shoe insert protects against both over-pronation and over-supination of the user's feet.

The golf shoe insert of the invention can be composed of a single layer or multiple layers of visoelastic, orthotic materials well known to the skilled artisan. An exemplary insert of the invention is constructed from elastic/foam polymer material that affords gentle, resilient support. The type of visoelastic materials used in the manufacture of the insert of the invention is optimally selected to correspond to various strength requirements. In addition, the inserts of the invention can be composed of more than one type of visoelastic material. Further, the inserts of the invention can include additional active agents such as carbon to aid in the elimination of odors.

According to the present invention, the shoe insert is manufactured from a visoelastic orthotic material so as to encourage the rolling motion of foot and shoe when walking. Further, the material is of sufficient rigidity to provide support and assistance in positioning a golfer's feet during a golf swing. Because the golf shoe insert is manufactured from a visoelastic orthotic material, golf shoe inserts fabricated in large quantities by the injection molding process are easily adjusted by the user to the size and contours of the individual shape of the foot of even small size patients.

According to the present invention, the visoelastic orthotic material of the golf shoe insert can be mass-manufactured by the injection molding process. Other embodiments can be mass-manufactured by designer cutting, molding, or forming of foams having durometers of 30–40.

Preferred visoelastic orthotic materials for construction of the inserts of the invention include, but are not limited to, polyurethane foams, polyethylene (PE) foams, polyvinyl chloride foams, ethylene vinyl acetate (EVA) foams, synthetic rubber foams, and the like. Inserts of the invention can also include cork, rubber materials such as synthetic rubber foams or silicone rubber, glue and fiberglass combinations, glass-filled nylon, composites, nylon, polypropelene, polymer gels such as polymer urethane gels, and the like. In certain embodiments of the invention, a combination or blend of visoelastic orthotic materials are used to prepare an insert.

By way of example, polyethylene foams can be vacuum formed, compression molded, hot-wire cut, water jet cut and die cut to form the golf shoe insert. Post-processing methods can include skiving the insert into a desired thickness or applying additional layers of foam of varying durometers. In a related embodiment, thermo and vacuum forming of polyethylene provides the golf shoe insert. Thermo and vacuum forming include the steps of heating the polyethylene material at 220°–250° F. until the material is uniformly heated and maleable, with exact temperatures dependent on the oven and the thickness and size of the material and then applying vacuum pressure at a minimum of 18 psi to form a desired golf shoe insert in accordance with the present invention.

In one embodiment, the main body of the insert is composed of a single layer of a visoelastic orthotic material. In another embodiment, the main body is formed of a dual layer construction. The lower surface of the main body is preferably composed of a visoelastic orthotic material that is of greater rigidity and firmness than the top surface. In a preferred embodiment, the lower surface is composed of a cushioning polyurethane foam layer and the upper surface is preferably formed of an EVA foam layer. The two layers of an insert of the invention can be coupled together using known adhesives.

In another embedment, the main body is formed from a flexible engineering polymer exhibiting intrinsic memory and recall, a room-temperature flexural modulus of about 350,000 psi and a tensile strength of about 7400 psi. A preferred polymeric material that is currently available is produced by Ever-Flex Laboratories.

In a method, according to the subject invention, of providing an individual relief from common pathologies of golfers including, for example, flat foot, high arches, heel spurs, and foot fatigue, an orthopedic golf shoe insert is provided and placed within the individual's golf shoe. The subject golf shoe insert can be used in lieu of the existing insole in a golf shoe. Once the existing insole in a golf shoe is removed, the subject golf shoe insert can be cut to the shape and size of an individual's foot and then placed within the golf shoe. The individual then wears the emplaced insert to support the foot and aid in improving the individual's golf swing.

It should be understood that the examples and embodiments described herein are for illustrative purposes only and that various modifications or changes in light thereof will be suggested to persons skilled in the art and are to be included within the spirit and purview of this application.

I claim:

1. A golf shoe insole insert for a golfer's foot comprising:

(a) a main body that is of a thin, flat base, comprising an upper surface, a lower surface, a lateral edge, a medial edge, a heel edge, a toe region, a medial region, a lateral region, and a heel region, wherein the toe region is formed from the thin, flat base, wherein the toe region has a distal toe region and a proximal toe region, wherein the heel region has a distal heel region and a proximal heel region, and wherein the medial region and the lateral region are separated along a longitudinal center-line;

(b) a heel cup located at the upper surface, heel region to aid in stabilizing the foot;

(c) a flange formed on the upper surface along the lateral edge, medial edge, and heel edge of the main body, wherein the flange gradually extends vertically upward from the medial edge to fully extend upward at the heel edge, from which the flange gradually tapers downward along the lateral edge to taper off near the toe region;

(d) an upper arch conforming slope located on the upper surface, in the medial region, wherein the arch conforming slope begins at the thin, flat base of the main body at the distal heel region, and gradually increases in height from the distal heel region along the medial region, and then gradually decreases in height from the medial region to the thin, flat base of the main body near the proximal toe region;

(e) a thickened portion located on the lower surface, longitudinally along the lateral region, wherein the thickened portion begins at the thin, flat base of the main body at a distal fifth metatarsal bone of the foot to the heel region; and (f) a lower arch conforming slope located on the lower surface, in the medial region, wherein the arch conforming slope begins at the thin flat base of the main body at the distal heel region, and gradually increases in height from the distal heel region along the medial region, and then gradually decreases in height from the medial region to the thin, flat base of the main body near the proximal toe region.

2. The insert according to claim 1, wherein the thickened portion is of greatest height along the longitudinal center-line and along a transverse arch of the foot and tapers down in height to the thin, flat base at the toe region, and wherein the thickened portion is of substantially the same thickness along the lower surface, lateral region from the transverse arch of the foot to the heel region.

3. The insert according to claim 1, wherein the insert is composed of at least one visoelastic orthotic material.

4. The insert according to claim 3, wherein the visoelastic orthotic material is selected from the group consisting of: polyurethane foams, polyethylene foams, polyvinyl chloride foams, ethylene vinyl acetate foams, synthetic rubber foams, cork, rubber materials, synthetic rubber foams, silicone rubber, glue and fiberglass combinations, glass-filled nylon, nylon, polypropelene, and polymer gels.

5. The insert according to claim 1, wherein the insert is formed of at least one layer.

6. The insert according to claim 5, wherein the insert is formed of three layers.

7. The insert according to claim 5, wherein the insert is formed of two layers.

8. The insert according to claim 7, wherein the first layer is on the lower surface and the second layer is on the upper surface, wherein the first layer is composed of a cushioning polyurethane foam layer, the second layer is formed of an EVA foam layer, and the polyurethane foam layer is coupled together with the EVA foam layer with an adhesive.

9. The insert according to claim 1, wherein the insert is composed of a visoelastic orthotic material which exhibits room temperature flexible modulus of approximately 350,000 psi.

10. The insert according to claim 1, wherein the insert is composed of a visoelastic orthotic foam having a durometer of 30–40.

11. The insert according to claim 1, further comprising an agent for controlling odors.

12. A method of improving an individual's golf swing and providing relief from common golfing pathologies comprising placing an insert comprising:

(a) a main body that is of a thin, flat base, comprising an upper surface, a lower surface, a lateral edge, a medial edge, a heel edge, a toe region, a medial region, a lateral region, and a heel region, wherein the toe region if formed from the thin, flat base, wherein the toe region has a distal toe region and a proximal toe region, wherein the heel region has a distal heel region and a proximal heel region, and wherein the medial region and the lateral region are separated along a longitudinal center-line;

(b) a heel cup located at the upper surface, heel region to aid in stabilizing the foot;

(c) a flange formed on the upper surface along the lateral edge, medial edge, and heel edge of the main body, wherein the flange gradually extends vertically upward from the medial edge to fully extend upward at the heel edge, from which the flange gradually tapers downward along the lateral edge to taper off near the toe region;

(d) an upper arch conforming slope located on the upper surface, in the medial region, wherein the arch conforming slope begins at the thin, flat base of the main body at the distal heel region, and gradually increases in height from the distal heel region along the medial region, and then gradually decreases in height from the medial region to the thin, flat base of the main body near the proximal toe region;

(e) a thickened portion located on the lower surface, longitudinally along the lateral region, wherein the thickened portion begins at the thin, flat base of the main body at a distal fifth metatarsal bone of the foot to the heel region; and (f) a lower arch conforming slope located on the lower surface, in the medial region, wherein the arch conforming slope begins at the thin flat base of the main body at the distal heel region, and gradually increases in height from the distal heel region along the medial region, and then gradually decreases in height from the medial region to the thin, flat base of the main body near the proximal toe region into a golf shoe; and playing golf using the golf shoe.

13. The method according to claim 12, wherein the thickened portion is of greatest height along the longitudinal center-line and along a transverse arch of the foot and tapers down in height to the thin, flat base at the toe region, and wherein the thickened portion is of substantially the same thickness along the lower surface, lateral region from the transverse arch of the foot to the heel region.

14. The method according to claim 12, wherein the insert is composed of at least one visoelastic orthotic material.

15. The method according to claim 14, wherein the visoelastic orthotic material is selected from the group consisting of: polyurethane foams, polyethylene foams, polyvinyl chloride foams, ethylene vinyl acetate foams, synthetic rubber foams, cork, rubber materials, synthetic rubber foams, silicone rubber, glue and fiberglass combinations, glass-filled nylon, nylon, polypropelene, and polymer gels.

16. The method according to claim 14, wherein the insert is composed of a visoelastic orthotic material which exhibits room temperature flexible modulus of approximately 350,000 psi.

17. The method according to claim 12, wherein the insert is formed of at least one layer.

18. The method according to claim 17, wherein the insert is formed of three layers.

19. The method according to claim 17, wherein the insert is formed of two layers.

20. The method according to claim 19, wherein the first layer is on the lower surface and the second layer is on the upper surface, wherein the first layer is composed of a cushioning polyurethane foam layer, the second layer is formed of an EVA foam layer, and the polyurethane foam layer is coupled together with the EVA foam layer with an adhesive.

* * * * *

UNITED STATES PATENT AND TRADEMARK OFFICE

CERTIFICATE OF CORRECTION

PATENT NO. : 6,973,743 B1
DATED : December 13, 2005
INVENTOR(S) : Tom Mowery

It is certified that error appears in the above-identified patent and that said Letters Patent is hereby corrected as shown below:

Title page, Item [54] and Column 1, line 1,
Title, "GOLD SHOE INSOLE INSERT" should read -- GOLF SHOE INSOLE INSERT --.

Signed and Sealed this

Twenty-eighth Day of March, 2006

JON W. DUDAS
*Director of the United States Patent and Trademark Office*